United States Patent [19]

Bush et al.

[11] 4,124,960

[45] Nov. 14, 1978

[54] PRESTRESSED CONCRETE TANK HAVING SEAMED DIAPHRAGM JOINTS SECURING ADJACENT PRECAST CONCRETE PANELS

[75] Inventors: Bill R. Bush, West Babylon; Jack Hornstein, Old Bethpage, both of N.Y.

[73] Assignee: Preload Company, Inc., Garden City, N.Y.

[21] Appl. No.: 825,832

[22] Filed: Aug. 18, 1977

Related U.S. Application Data

[63] Continuation-in-part of Ser. No. 636,729, Dec. 1, 1975, Pat. No. 4,043,089.

[51] Int. Cl.[2] ..... E04D 1/00; E04C 3/10

[52] U.S. Cl. ..... 52/583; 52/224; 52/249; 52/743

[58] Field of Search ..... 52/598, 588, 417, 249, 52/443, 224, 225, 598, 583, 587, 599, 743

[56] References Cited

U.S. PATENT DOCUMENTS

| | | | |
|---|---|---|---|
| 2,049,863 | 8/1936 | Palmer | 52/588 |
| 3,280,525 | 10/1966 | Crowley | 52/249 |

*Primary Examiner*—John E. Murtagh

*Attorney, Agent, or Firm*—Curtis, Morris & Safford

[57] ABSTRACT

An improved prestressed concrete tank having a core wall comprising elongated panels of precast concrete having on their outer faces a sheet of sheet metal presenting parallel, longitudinal, undercut channels is shown. The panels include lateral sheet metal flanges which extend parallel to the elongated sides of the panels and laterally outward therefrom. The flanges have a flange lip on the outermost edge of the flange. The lip extends outwardly from the tank in a direction substantially perpendicular to the panel. The panels are assembled in spaced, side-by side- relationsip such that the flange lips of adjacent panels are spaced from one another. A sheet metal splice member having a channel shape is interposed in the space between the flange lips of the adjacent panels. The splice member has upstanding sides which abut the lips of the adjacent flanges. The upstanding side and the flange lip adjacent to it are seamed together in a tight fold, thus locking the adjacent panels together. The advantages of this technique is that it creates a tighter, more waterproof seam between adjacent panels without penetrating the sheet metal diaphragm with sheet metal screws or other fasteners. Furthermore, such a joint eliminates the use of sealants in joining adjacent panels.

8 Claims, 10 Drawing Figures

PRESTRESSED CONCRETE TANK HAVING SEAMED DIAPHRAGM JOINTS SECURING ADJACENT PRECAST CONCRETE PANELS

This is a continuation in part of application Ser. No. 636,729 filed Dec. 1, 1975 now U.S. Pat. No. 4,043,089.

This invention comprises a concrete tank of improved structure which is easy to assemble on-site from precast concrete units. More specifically, this invention relates to prestressed concrete tanks wherein the concrete core wall is comprised of elongated precast concrete panels having an outer facing of steel sheet. Even more specifically, this invention relates to a novel and economical method for connecting adjacent precast concrete panels to form an integrated assembly having reliable, water tight joints.

Concrete tanks have heretofore been erected from the ground up at the work site. This method of operation is inefficient because work is subjected to delays due to weather unavailability of materials or labor, etc. Efforts have therefore been made to bring to the work site, precast concrete units which can be fabricated at convenient times and places and typically indoors.

The precast panels typically include a sheet metal sheathing which is permanently bonded to one face of a precast concrete panel. The sheathing presents a plurality of parallel, longitudinal channels which form a site upon which mortar may be projected to form an outer coating or wall on the erected panels. Typically, these precast units are formed of hydraulic concrete deposited upon a sheet steel diaphragm in which the parallel, longitudinal channels have already been formed, the panels being of a length in accordance with the height of the contemplated tank.

While the advent of precast concrete panels has simplified the on-site erection of prestressed concrete tanks, problems have been encountered in connecting and sealing the precast units to one another. U.S. Pat. No. 3,280,525, to Crowley suggests a technique for connecting and sealing precast panels to one another wherein a half channel is formed on both edges of each precast panel so that adjacent panels present one full channel which can be locked in place by the insertion of metal key plate having a cross section similar to that of the channels but just slightly smaller in size so as to fit snuggly when driven in place.

The primary object of this invention is to provide a simpler, more economical and more reliable method and precast panel configuration so that precast concrete panels having channels may be more efficiently connected to one another in the erection of a precast concrete tank.

It is also an object of this invention to avoid the expense of providing and handling separate cover plates as are used in U.S. Pat. No. 3,280,525.

It is also a very important object of this invention to reduce the number of seals in the joinery between the adjacent concrete panels so that the chance of leakage from within the tank is reduced and the amount of sealant and the work necessary to apply that sealant is also reduced.

These and other objects of this invention are achieved in a prestressed concrete tank having a core wall comprising elongated panels of precast concrete having on their outer faces, a sheet of sheet metal presenting parallel, longitudinal, undercut channels. The panels also include two lateral, sheet metal flanges which extend parallel with the elongated sides of the panels and laterally outwardly therefrom. The panels are assembled in spaced, side-by-side relationship such that the sheet metal flanges on adjacent panels overlap one another. The overlapping flanges are then fastened to one another, preferably with sheet metal screws and an elastomeric compound is used to seal the joint. The advantages of the instant invention are that the steel skin over the filler joints is part of the steel skin on the panels and a separate cover plate is not required. Moreover, when the concrete panels are erected, the joint cover is automatically in place except for sealing and this eliminates the problem of handling a separate cover plate. Also, there is only one joint line to seal with elastomeric compound versus two joint lines in the tank configuration of U.S. Pat. No. 3,280,525 and thus the amount of elastomeric material and labor that is required is reduced by about one half. The invention reduces the change of leakage from the tank considerably.

The foregoing invention is highly satisfactory in eliminating expensive cover plates, reducing the joinery and reducing the likelihood of leakage. However, it has now been found that by providing the sheet metal diaphragm with seamed joints set within the precast concrete, the resulting prestressed tank is even more reliable and satisfactory.

It is a further object of the present invention to provide an improved precast concrete panel which further reduces the likelihood of leakage from the tank.

It is a further object of the present invention to provide an improved means of securing the steel metal sheet to the precast concrete of the panel.

it is also an object of the present invention to provide an improved means for preventing the sheet metal diaphragm from peeling away from the precast concrete at the edge of each panel.

These and other objects of this invention are achieved in a panel, having on its outer surface a plurality of elongated sheets of sheet metal. At least one of the sheets of sheet metal has parallel longitudinal undercut channels and each sheet has at least one lip which extends from the interior side of the sheet metal sheet into the precast concrete. The lips of adjacent sheets are fastened together to form a joint in the precast concrete. The advantages of such of construction are that, in addition to the securing effect achieved by the undercut channels in the sheet metal, the joint is firmly anchored in the precast concrete thus securing the sheet metal to the precast concrete. At the edge of the panel, the joint anchored in the precast concrete prevents the sheet metal from peeling away from the precast concrete. This minimizes the tendency of the sheet metal diaphragm to peel away from the edge of the panel and thereby improves the joint between adjacent panels and minimizes leaks in the tanks at positions where adjacent panels are connected. At positions interior to the edge of the panels, the joint locks the sheets together and fixedly secures them to the precast concrete.

Furthermore, it has now been found that the abovementioned seaming technique is not only useful in seaming metal sheets together in the formation of precast concrete panels but is also useful in seaming adjacent panels together thus producing a prestressed tank which is even more reliable and economical.

It is an object of the invention to eliminate the use of sealing in adjoining the adjacent precast concrete panels together.

It is also an object of the invention to allow formation of panels and tanks using a single seaming device thus reducing costs and complexity.

It is also an important object of this invention to create a tighter, more waterproof seam between adjacent panels thus reducing the chance of leakage from within the tank.

Likewise, it is an object of the invention to provide a reliable seam between adjacent panels which does not require the penetration of the sheet metal with sheet metal screws.

These and other objects of the invention are achieved in a prestressed concrete tank having a core wall comprising elongated panels of precast concrete having on their outer faces a sheet of sheet metal presenting parallel, longitudinal, undercut channels. The panels include lateral sheet metal flanges which extend parallel to the elongated sides of the panels and laterally outward therefrom. The flanges have a flange lip on the outermost edge of the flange. The lip extends outwardly from the tank in a direction substantially perpendicular to the panel. The panels are assembled in spaced, side-by-side relationship such that the flange lips of adjacent panels are spaced from one another. A sheet metal splice member having a channel shape is interposed in the space between the flange lips of the adjacent panels. The splice member has upstanding sides which abut the lips of the adjacent panels. The upstanding side and the flange lip adjacent to it are seamed together in a tight fold, thus locking the adjacent panels together. The advantage of this technique is that it creates a tighter, more waterproof seam between adjacent panels without penetrating the sheet metal diaphragm with sheet metal screws or other fasteners. Furthermore, such a joint eliminates the use of sealants in joining adjacent panels.

The invention is more fully described in the accompanying drawing, in which.

Figure 1:
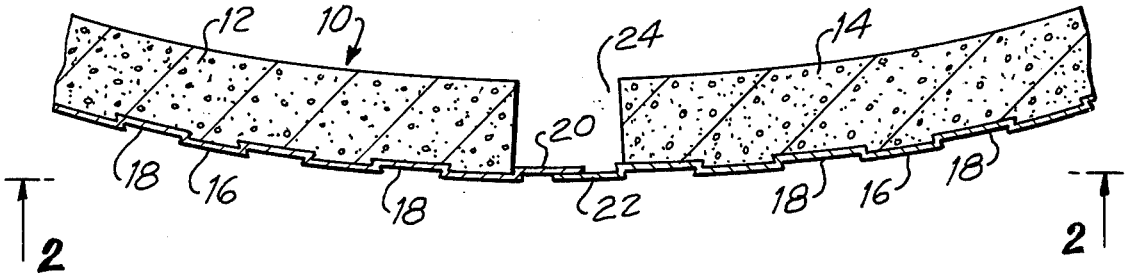
FIG. 1 is a cross sectional plan view of portions of the concrete tank of this invention showing the assembled panels.

In FIG. 1, reference 10 refers generally to a concrete core wall formed from two precast concrete panels 12 and 14. Each of panels 12 and 14 has an outer face of sheet metal 16 which presents a plurality of parallel, longitudinal undercut channels 18. The sheet sheet 16 on each of panels 12 and 14 extends past the edge of the panel to form a flange 20 on panel 12 and a flange 22 on panel 14. These flanges extend parallel with the vertical sides of panels 12 and 14 and extend laterally outwardly therefrom. Panels 12 and 14 are separated by space 24.

Figure 2:
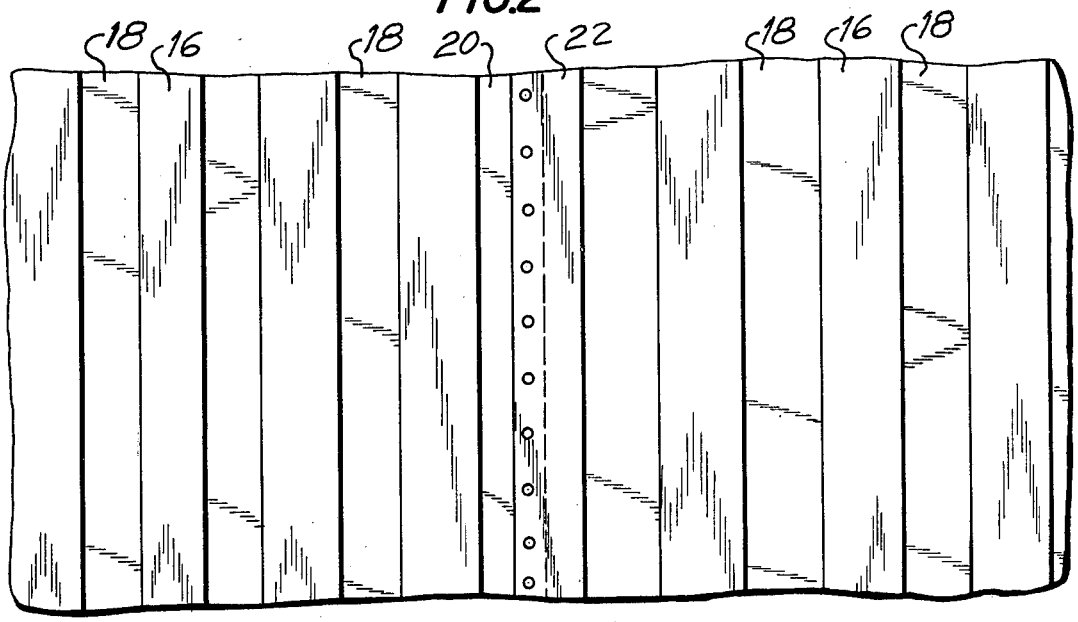
FIG. 2 is a elevation view along lines 2—2 of FIG. 1.
Figure 3:
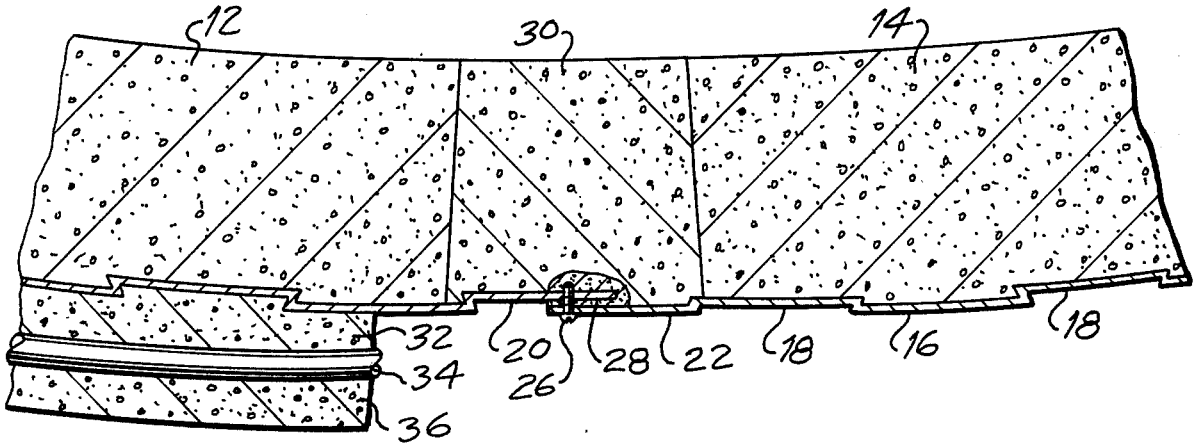
FIG. 3 is a further cross sectional plan view of a completed tank according to the invention.

With reference to FIG. 2, flanges 20 and 22 on panels 12 and 14, respectively, overlap one another and are fastened to one another by means of sheet metal screws 26. The joint is filled with an elastomeric material 28 and the entire joint between panels 12 and 14 is filled with filler concrete 30. The elastomeric materials which are used to seal the joint may be any of those known for this purpose including silicone rubbers, polysulfides and the like.

After the core wall is erected as described, an intermediate wall 32 of cement is formed on the outer steel facing of the panels. Pneumatically projected mortar is used to form an outer coating or wall which tightly seals in the parallel, longitudinal, undercut channels 18 in the sheet metal facing of the panels. After the intermediate wall 32 is formed the tank may be prestressed by wires 34 and the wires are covered with a further cementitious covering 36.

Figure 4:
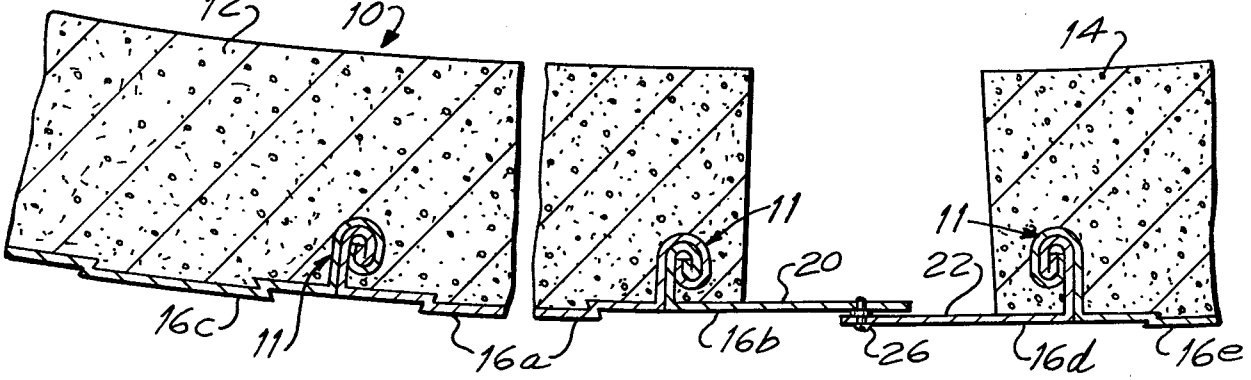
FIG. 4 is a cross sectional plan view of portions of the concete tank of this invention showing the assembled panels and the seamed joints.

FIG. 4 is essentially the same as FIG. 1 except that the seamed joints 11 have been added at interior portions of each panel and at the panel edges. Each panel 12 and 14 is made up of more than one metal sheet. The sheets **16*a*, 16*c* and 16*e* contain parallel, longitudinal undercut channels 18. The edge of panel 12 is provided with sheet 16*b* and the edge of panel 14 is provided with sheet 16*d*, neither of which have undercut channels. The lateral extensions of sheet 16*b* and 16*d* from flanges 20 and 22, respectively. The adjacent sides of sheet metal are provided with lips which have been seamed together in a tight fold to form a joint 11**, which is anchored in the precast concrete.

Figure 5:
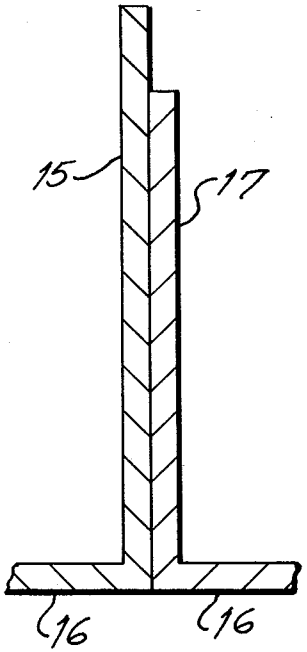
FIG. 5 is a cross sectional plan view of a pair of adjacent sheet metal sheets and the lips provided thereon prior to seaming.

The joint may be formed by using the seaming machine disclosed and described in U.S. Pat. No. 3,120,828. More specifically, the machine presently being used to form the seams is the ROOF RUNNER*TM* machine which is available from the Butler Research Co., Kansas City, Mo. Referring to FIGS. 4 and 5, the metal sheets **16*a* and 16*c* are provided with upstanding lips 15 and 17 which are in abutting side-by-side relationship. Likewise, in order to form the joint at the edge of the panel 12, the metal sheets 16*a* and 16*b* are provided with upstanding lips 15 and 17** arranged in abutting side-by-side relationship. Preferably the sheets to be joined by seaming are laid flat upon a work surface with the lips extending upwardly.

Figure 7:
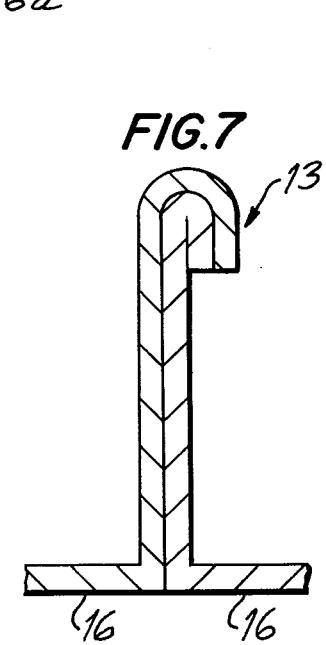
FIG. 7 is a cross sectional plan view of a pair of adjacent sheet metal sheets showing a seamed joint according to the present invention.
Figure 8:
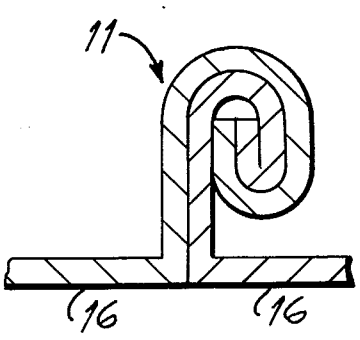
FIG. 8 is a cross sectional plan view of a pair of adjacent sheet metal sheets showing a preferred seamed joint according to the present invention.

The seaming device is placed at one end of the upstanding lips 15 and 17 and the carriage is moved along the lips. A series of rolls and counterrolls cause lip 15 to be folded over or together with and over lip 17 seaming the two adjacent sheets together into a folded joint 13 as shown in FIG. 7. A second pass of the seaming machine causes the folded joint 13 to be folded again into the joint 11 as shown in FIG. 8. After the joint 11 is formed the panel is completed by depositing hydraulic concrete upon the sheet metal. The concrete covers the joint 11 thereby locking the sheet into the concrete.

Figure 6:
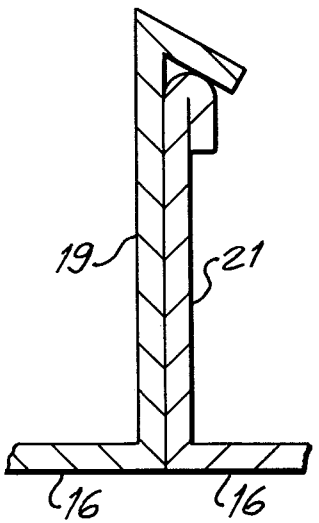
FIG. 6 is a cross sectional plan view of a preferred embodiment of a pair of adjacent sheet metal sheets and the lips provided thereon prior to seaming.

Referring to FIG. 6, a preferred lip form is shown. The preferred lip form includes a male lip 21 and female lip 19 which are prerolled by conventional methods. The male lip 21 is formed by turning back the metal.

The female lip 19 is turned over the male lip 21 to form an inverted V with an angle of approximately 30° C. The advantage of this preferred lip form is that a single pass of the seaming machine will result in the formation of the doubly folded joint shown in FIG. 8.

Figure 9:
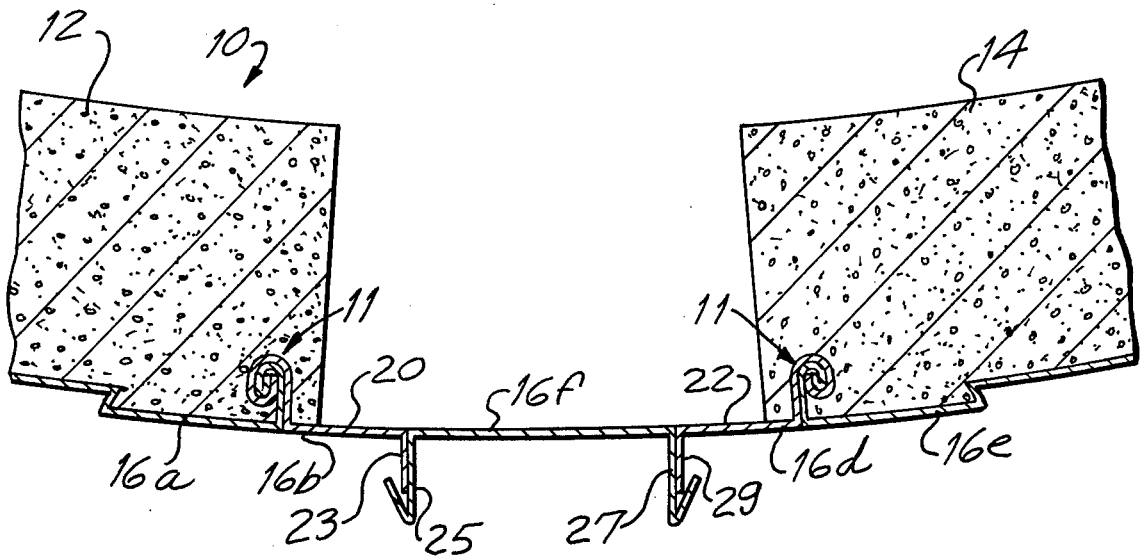
FIG. 9 is a cross sectional plan view of a portion of the concrete tank showing the splice member interposed between the flange lips of the adjacent panels prior to seaming.
Figure 10:
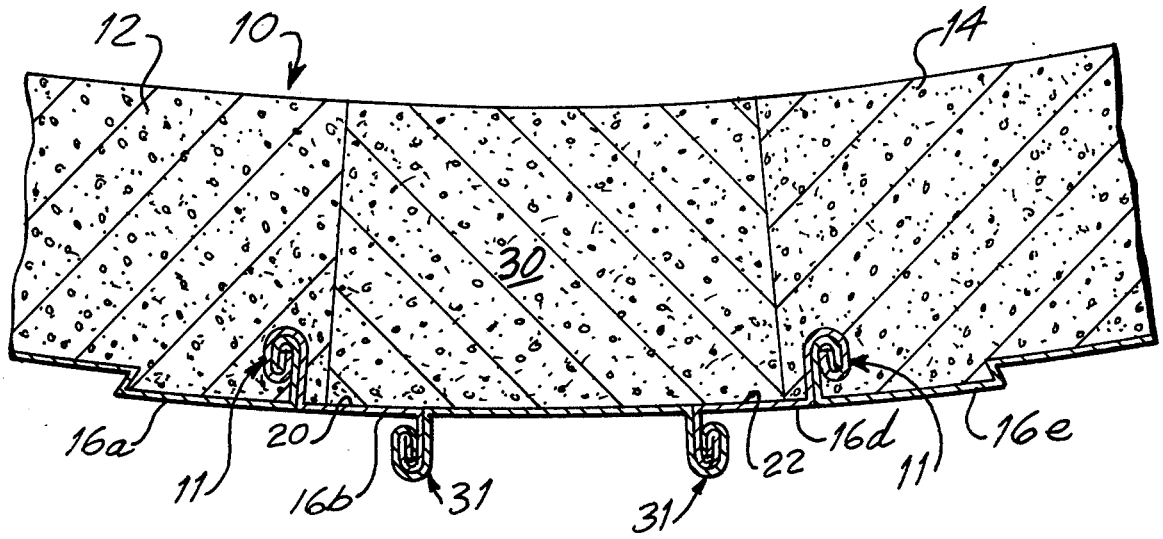
FIG. 10 is a cross sectional plan view of a portion of the concrete tank showing the improved means for locking adjacent panels together.

FIGS. 9 and 10 are essentially the same as FIG. 4 except that the improved method of joining the precast panels is illustrated.

Referring to FIGS. 9 and 10, the flanges 20 and 22 are provided with flange lips 23 and 29, respectively, which extend outwardly from the tank in a direction substantially perpendicular to the panel. The panels 12 and 14 are erected such that there is a space between them. A channel shaped splice member **16*f* is interposed in the space between the panels 12 and 14. The splice member 16*f* is sheet metal and has two upstanding sides 25 and 27. Side 25 abuts flange lip 23 and side 27 abuts flange 29**. Using the ROOF RUNNER*TM* machine in the same manner described above for the formation of joints 11, except that it is used to vertically seam the adjacent erected panels, tightly folded seams 31 are formed. The entire space between panels 12 and 14 is filled with filler concrete 30.

Another embodiment of the invention comprises aligning panels 12 and 14 so that flange lips 23 and 29 are side-by-side and abutting in a manner analogous to FIGS. 5 and 6 and forming a single seam to join the adjacent precast panels.

The majority of the time the placement of the sheet metal diaphragm is on the outside surface of the structure. However, there are times, primarily due to job site conditions, exterior connections or inability to brace inwardly, where the sheet metal diaphragm is placed on the inside surface of the structure. This is accommodated by reversing the direction of the curvature in the panel beds. All other aspects of the decription remain identical but, on the interior surface except for the horizontal prestressing which remains on the exterior of the structure.

What is claimed is:

1. An improved prestressed concrete tank having a core wall comprising elongated panels of precast concrete assembled in space, side-by-side relationship, each of said panels having on a face a sheet of sheet metal presenting parallel longitudinal undercut channels and a lateral, sheet metal flange extending parallel with the elongated sides of said panels and laterally outwardly therefrom, said sheet metal flange having a lip on the outermost edge of said flange which extends from the tank in the direction substantially perpendicular to the panel, said flange lips of adjacent panels being spaced from one another; a sheet metal, channel shaped splice member interposed in said space between the flange lips of adjacent panels, said splice member having upstanding sides which abut the flange lips of adjacent panels and said flange lip and abutting upstanding side being seamed together in a tight fold, thereby locking adjacent precast concrete panels together with a watertight seam.

2. A concrete tank as recited in claim 1, wherein each of said panels has on a face a plurality of elongated sheets of sheet metal, at least one of said sheets presenting parallel longitudinal undercut channels, said sheets having a lip extending inwardly into the precast concrete, said lips of adjacent sheets being fastened together to form a joint which is set within the concrete.

3. A concrete tank as recited in claim 2, wherein said joint is formed by seaming the lips together in a tight fold.

4. A concrete tank as recited in claim 1, wherein said flange lip and abutting upstanding side have lengths that differ and are seamed together by folding the longer length over the shorter length in a tight fold.

5. An improved prestressed concrete tank having a core wall comprising elongated panels of precast concrete assembled in spaced, side-by-side relationship, each of said panels having on a face a sheet of sheet metal presenting parallel longitudinal undercut channels and a lateral sheet metal flange extending parallel with the elongated sides of said panels and laterally outwardly therefrom, said sheet metal flange having a lip on the outermost edge of said flange which extends from the tank in a direction substantially perpendicular to the panel, said flange lips of adjacent panels being aligned adjacent to and abutting each other and said flange lips being seamed together in a tight fold thereby locking adjacent precast panels together in a watertight seam.

6. A method for forming prestressed concrete tanks comprising the steps of aligning elongated precast concrete panels side by side, said concrete panels having a sheet metal flange which extends parallel with the elongated sides of the panel and laterally outwardly therefrom, said sheet metal flange having a flange lip extending from said tank is in a direction substantially perpendicular to the panel and being adjacent to and abutting the flange lip of the adjacent panel; seaming the adjacent flange lips together in a tight fold, and depositing concrete in the space formed between the outwardly extending flanges and precast concrete of adjacent panels.

7. A method for forming prestressed concrete tanks comprising the steps of aligning elongated precast concrete panels side by side, said concrete panels having a sheet metal flange which extends parallel with the elongated sides of the panels and laterally outwardly therefrom, said sheet metal flange having a flange lip extending from said tank in a direction substantially perpendicular to the panel, said flange lips of adjacent panels being spaced from one another; interposing a splice member between the flange lips of adjacent panels, said splice member having upstanding sides which abuts the flange lips of adjacent panels; seaming the upstanding side and abutting flange lip together in a tight fold; and depositing concrete in the space formed between the outwardly extending flanges, the splice member and the precast concrete of adjacent panels.

8. An improved prestressed concrete tank having a core wall comprising elongated panels of precast concrete assembled in spaced, side-by-side relationship, each of said panels having on its outer face a sheet of sheet metal presenting parallel longitudinal undercut channels and a lateral, sheet metal flange extending parallel with the elongated sides of said panels and laterally outwardly therefrom, said sheet metal flange having a lip on the outermost edge of said flange which extends outwardly from the tank in a direction substantially perpendicular to the panel, said flange lips of adjacent panels being spaced from one another; a sheet metal, channel shaped splice member interposed in said space between the flange lips of adjacent panels, said splice member having upstanding sides which abut the flange lips of adjacent panels and said flange lip and abuting upstanding side being seamed together in a tight fold, thereby locking adjacent precast concrete panels together with a watertight seam.

* * * * *

UNITED STATES PATENT AND TRADEMARK OFFICE

CERTIFICATE OF CORRECTION

PATENT NO. : 4,124,960

DATED : November 14, 1978

INVENTOR(S) : Bill R. Bush and Jack Hornstein

It is certified that error appears in the above-identified patent and that said Letters Patent are hereby corrected as shown below:

COLUMN 5, CLAIM 1, LINE 44, "space" should be -- spaced --.

COLUMN 6, CLAIM 6, LINE 28, after "tank" delete "is".

COLUMN 6, CLAIM 6, LINE 31, after "fold" delete "," and insert -- ; --.

COLUMN 6, CLAIM 7, LINE 44, "abuts" should be -- abut --.

COLUMN 6, CLAIM 8, LINE 65, "abuting" should be -- abutting --.

Signed and Sealed this

*Fifth* Day of *June 1979*

[SEAL]

*Attest:*

RUTH C. MASON
*Attesting Officer*

DONALD W. BANNER
*Commissioner of Patents and Trademarks*